US005419255A

United States Patent [19]

Reffert

[11] Patent Number: 5,419,255

[45] Date of Patent: May 30, 1995

[54] DEVICE FOR FORMING A PRINTING PATTERN ON A PRINTING SLEEVE

[75] Inventor: Roland Reffert, Frankenthal, Germany

[73] Assignee: Albert-Frankenthal Aktiengesellschaft, Wurzburg, Germany

[21] Appl. No.: 49,186

[22] Filed: Apr. 21, 1993

[30] Foreign Application Priority Data

Apr. 21, 1992 [DE] Germany ..... 42 13 013.1

[51] Int. Cl.[6] ..... B41C 1/00

[52] U.S. Cl. ..... 101/463.1; 101/401.1; 101/467; 101/375

[58] Field of Search ..... 101/389.1, 375, 463.1, 101/467, 401.1, 376; 156/905

[56] References Cited

U.S. PATENT DOCUMENTS

| | | | |
|---|---|---|---|
| 3,136,672 | 6/1964 | Prongay | 156/905 |
| 3,271,226 | 9/1966 | Staehle et al. | 156/345 |
| 4,116,594 | 9/1978 | Leanna et al. | 425/3 |
| 4,308,091 | 12/1981 | Schmitt et al. | 156/905 |
| 4,347,785 | 9/1982 | Chase et al. | 101/467 |
| 4,572,889 | 2/1986 | Imai et al. | 101/463.1 |
| 4,812,219 | 3/1989 | Sattrup et al. | 101/375 |
| 4,833,990 | 5/1989 | Hirt et al. | 101/467 |
| 4,868,090 | 9/1989 | Kitamura et al. | 101/463.1 |
| 5,194,881 | 3/1993 | Hirt | 101/463.1 |
| 5,247,884 | 9/1993 | Rid | 101/401.1 |

FOREIGN PATENT DOCUMENTS

| | | |
|---|---|---|
| 0098574 | 7/1983 | European Pat. Off. . |
| 0394871 | 4/1990 | European Pat. Off. . |
| 1760330 | 5/1968 | Germany . |
| 2742002 | 9/1977 | Germany . |
| 8122637 | 8/1981 | Germany . |
| 3916372 | 11/1990 | Germany . |

*Primary Examiner*—Edgar S. Burr
*Assistant Examiner*—Lynn D. Hendrickson
*Attorney, Agent, or Firm*—Jones, Tullar & Cooper

[57] ABSTRACT

A device for creating a printing pattern on an endless form sleeve utilizes a pattern forming head that is cooperatively positioned with an outer surface of an endless, sleeve. The sleeve has an inner ply of a ferromagnetic material and is supported in part by a support cylinder which may also be magnetic. A sleeve tensioning assembly is used to tension that part of the endless sleeve which is not supported by the cylinder.

10 Claims, 5 Drawing Sheets

FIG. 2
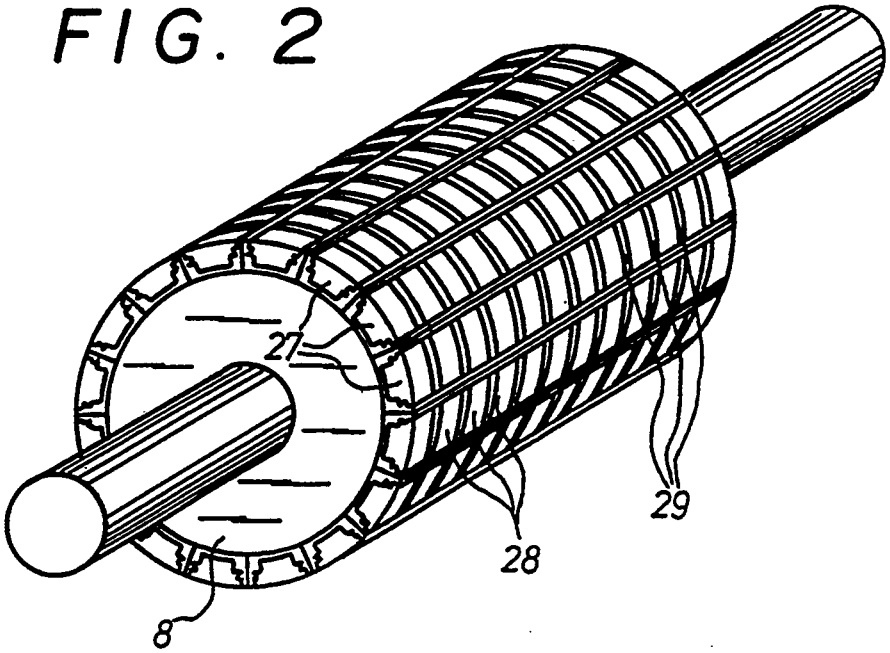
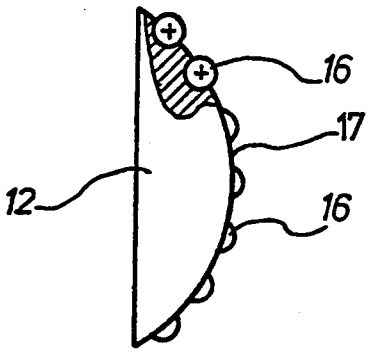
FIG. 3

DEVICE FOR FORMING A PRINTING PATTERN ON A PRINTING SLEEVE

FIELD OF THE INVENTION

The present invention is directed generally to a device for forming a printing pattern on a printing or forme sleeve. More particularly, the present invention is directed to a device for forming a printing pattern on a jacket of a forme sleeve. Most specifically, the present invention is directed to an assembly for forming a printing pattern on a flexible forme sleeve which is supported by a magnetic support cylinder. The printing pattern is created or formed on the jacket or outer surface of an outer layer of a printing sleeve by use of a suitable pattern forming mechanism. The printing or forme sleeve on which the printing pattern is formed, is supported by a magnetic support cylinder. The inner circumferential length of the printing sleeve may be greater then the circumferential length of the magnetic support cylinder. A suitable sleeve tensioning assembly is utilized to support that portion of the printing sleeve which is not carried by the magnetic support cylinder.

DESCRIPTION OF THE PRIOR ART

It is known generally in the art to utilize an endless sleeve as a printing plate or printing surface. In one prior art device, as disclosed in German document No. DE 81 22 637 A1 there is shown a web-fed rotary printing press which utilizes an endless printing tape that carries print images. This endless printing sleeve or forme sleeve is supported by a cylinder and has a printing pattern formed on an outer surface or jacket of the sleeve. Various engraving tools, laser beams or electron beams may be used to create or form the printing pattern on the printing sleeve. This printing sleeve or forme sleeve may be an endless circular forme, such as a rotogravure forme. The forme, which may be a removable jacket, is supported by a cylinder. During creation of the printing pattern on the sleeve, the cylinder which supports the forme will be rotated. If the size of the format that is to be printed changes and thus if the size of the sleeve is changed beyond a specific permissible amount, the interior diameter or circumference of the cylinder must also be changed. The change in the size of the cylinder can only be accomplished by the removal of one cylinder and the substitution of another, different cylinder having the new, different diameter which will accept the changed format which is to be printed. The need to change cylinders when the format size of the material to be printed changes requires a significant amount of time and effort.

It will thus be seen that a need exists for a device for forming a printing pattern on a printing or forme sleeve which will facilitate the formation of the printing pattern on endless forme or printing sleeves of varying circumferential lengths. The use of endless sleeves of varying lengths on a single support cylinder in conjunction with a sleeve tensioning device thus accommodates changes in format without the need to accomplish a cylinder change. The device for forming a printing pattern on a forme sleeve in accordance with the present invention provides for the formation of endless forme sleeves of various lengths and is a significant improvement over the prior art.

SUMMARY OF THE INVENTION

It is an object of the present invention to provide a device for forming a printing pattern on a forme sleeve.

Another object of the present invention is to provide a device for creating a printing pattern on the jacket of a forme sleeve.

A further object of the present invention is to provide a device for forming a printing pattern on an endless printing sleeve which is supported by a cylinder.

Still another object of the present invention is to provide a device for forming a printing pattern on an endless forme sleeve whose length may be varied in accordance with the format to be printed.

Yet a further object of the present invention is to provide a device for the formation of a printing pattern on an endless, flexible forme sleeve which is supported, in part by a magnetic support cylinder.

Even still another object of the present invention is to provide a device for creating a printing pattern on an endless, flexible forme sleeve which utilizes a sleeve tensioning assembly to tension the portion of the forme sleeve which is not supported by the magnetic support cylinder.

As will be discussed in greater detail in the description of the preferred embodiment which is set forth subsequently, the device for creating a printing pattern on a forme sleeve in accordance with the present invention utilizes an endless, flexible printing or forme sleeve having an outer jacket or sleeve surface upon which a printing pattern is formed by use of engraving tools, laser beams or the like. This endless forme sleeve has an inner layer or ply which includes a ferro-magnetic material. The endless printing or forme sleeve is supported over at least a portion of its circumferential length in an area adjacent the printing pattern forming apparatus by a magnetic support cylinder. This magnetic support cylinder is usable with a variety of endless forme or printing sleeves having different circumferential lengths. A sleeve tensioning assembly is utilized in conjunction with the magnetic support cylinder to support that part of the forme sleeve which, due to its greater circumferential length, is not supported by the magnetic support cylinder. The sleeve tensioning assembly may be positioned in the space within the forme sleeve yet exterior of the magnetic support cylinder, or may be positioned exteriorly of the endless sleeve.

The primary advantage of the device in accordance with the present invention is that various endless forme sleeves can be supported while a printing pattern is formed on an outer jacket or sleeve surface by a suitable pattern forming assembly, such as engraving tools, laser beams, electron beams or the like. These various sizes of endless sleeves are all supported by a magnetic support cylinder of a single size. The use of the sleeve tensioning assembly of the present invention provides the needed support for the endless sleeves of varying lengths. The magnetic support cylinder supports the portion of the endless forme sleeve adjacent the printing pattern forming tool but does not have to support the entire sleeve. This means that it is no longer necessary to change support cylinders when the format size of the materials to be printed and thus the size of the endless forme sleeve changes.

It will thus be seen that the device for creating printing patterns on endless forme sleeves in accordance with the present invention overcomes the limitations of the prior art devices and is a substantial advance in the art.

BRIEF DESCRIPTION OF THE DRAWINGS

While the novel features of the device for creating a printing pattern on a forme sleeve in accordance with the present invention are set forth with particularity in the appended claims, a full and complete understanding of the present invention may be had by referring to the detailed description of the preferred embodiment which is set forth subsequently, and as illustrated in the accompanying drawings, in which:

FIG. 2 is a perspective view of a magnetic support cylinder for use in the present invention;

FIG. 3 is an enlarged, side elevation view of a first sleeve tensioning assembly.

DESCRIPTION OF THE PREFERRED EMBODIMENTS

Figure 1:
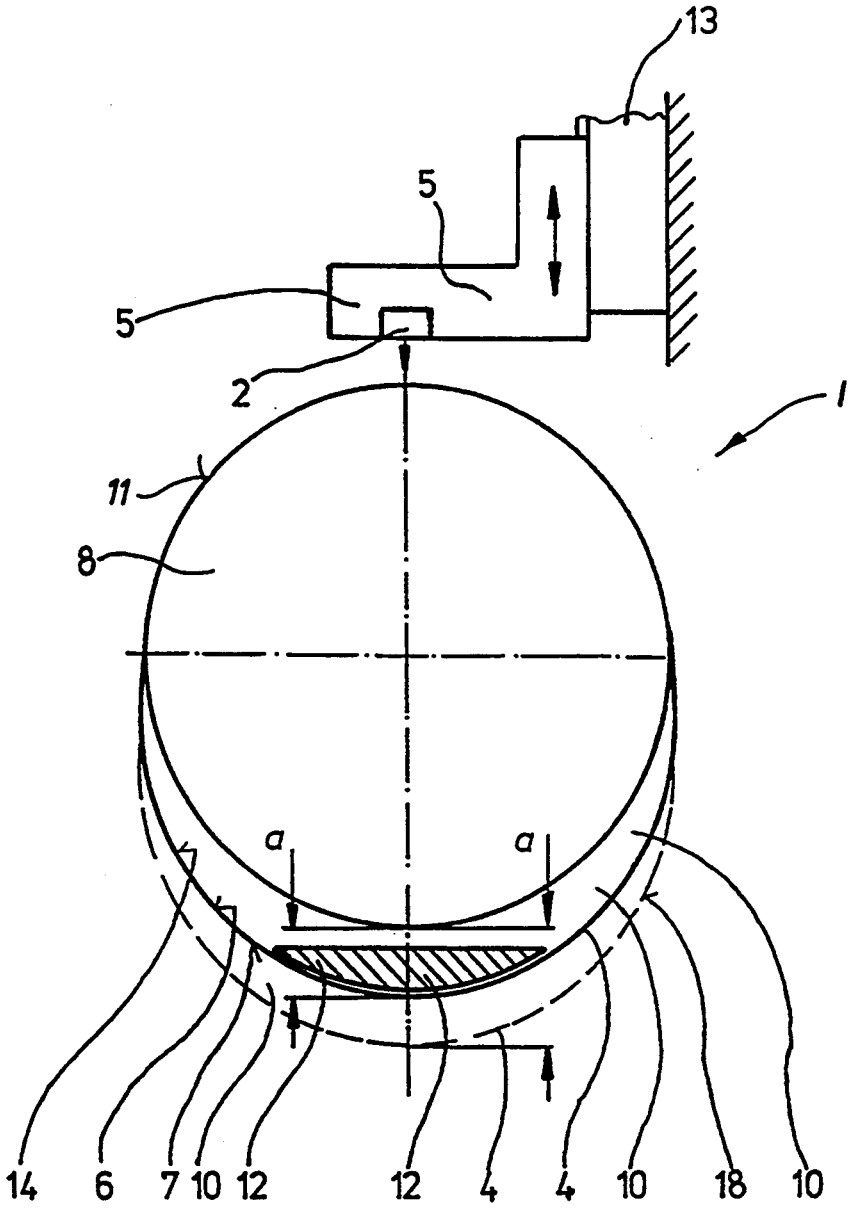
FIG. 1 is a schematic side elevation view of a device for creating a printing pattern on a forme sleeve in accordance with the present invention.
Figure 4:
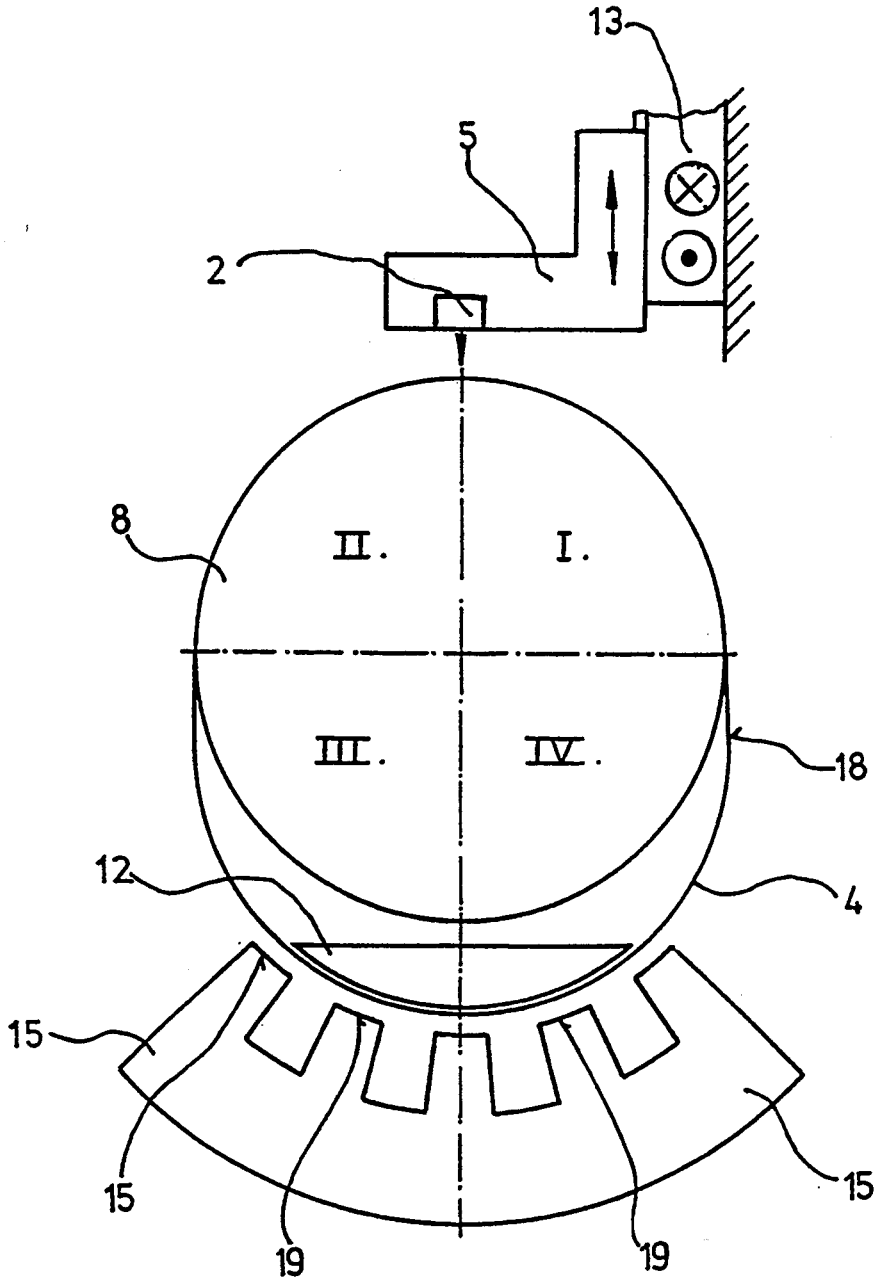
FIG. 4 is a schematic side elevation view of the device of the present invention and showing a second sleeve tensioning assembly in accordance with the present invention.

Referring initially primarily to FIG. 1 and also as shown in FIG. 4, there is shown, generally at 1 a device for creating a printing pattern on a forme sleeve, generally at 4, in accordance with the present invention. The printing sleeve 4 is an endless sleeve whose circumferential length is variable in accordance with the format which is to be printed using the forme or printing sleeve 4. In use, a printing pattern that is applied to the sleeve will then be used to print a sheet or web of material.

The printing sleeve 4 has an inner layer or ply 6 and an outer layer or ply 18. The inner peripheral layer 6 of the endless printing sleeve 4 consists of a ferro-magnetic material, such as for example iron, nickel, or suitable alloys. This ferro-magnetic material is formed at least on the inner peripheral layer 6 of the endless printing sleeve 4. The outer layer 18 of the endless print sleeve 4 can be of another material which may or may not be ferro-magnetic. For example, the outer layer 18 of sleeve 4 can be an oleophilic copper, or of an ink transferring rubber at an indirect pressure.

An outer jacket surface 7 of the endless printing sleeve 4 has a pattern to be printed applied to it by a work head 5 which, as may be seen in FIGS. 1 and 4, is movable both horizontally and vertically in a guide or carriage 13 that is secured to a frame assembly. The work head 5 includes some type of assembly, generally at 2 for generating shallow indentations on the jacket surface 7 of the endless printing sleeve 4. This indentation generating assembly 2 can be a generally known engraving device, a laser device, an electron beam device, a digital exposure device or a similar assembly which is used to form half tone dots or another printing pattern on the jacket surface 7 of the endless sleeve 4. This pattern to be printed may consist of up to 30,000 shallow indentations per sec., for example, and which can be between 3 and 30$\mu$ deep. These indentations can be formed or "worked into" the jacket surface 7 of the endless printing sleeve 4. As previously mentioned, the work head 5, can support a digital exposure unit 2 for an offset plate printing sleeve.

As may be seen by again referring to FIGS. 1 and 4, the endless printing or forme sleeve 4 is supported over at least a portion of its inner circumferential length on a rotatable magnetic support cylinder 8. The inner circumferential length of the sleeve 4 is preferably greater than the circumferential length of the magnetic support cylinder 8. Since at least the inner ply 6 of the sleeve 4 is of a ferromagnetic material, such as iron, nickel or a suitable alloy, and since the surface of the magnetic support cylinder 8 is a permanent magnet, as will be discussed in detail shortly, the sleeve 4 is firmly held by the cylinder 8 along the area in which they are co-extensive.

The printing sleeve 4 is placed on the magnetic support cylinder 8 and is held there by the magnetic cooperation between the magnetic support cylinder 8 and the ferro-magnetic inner ply 6 of the endless printing sleeve 4. In positioning the endless printing sleeve 4 on the magnetic support cylinder 8, the sleeve 4 is placed in contact with the first and second quadrants of the cylinder 8. As may be seen in FIG. 1, since the peripheral length of the sleeve 4 may be greater than the peripheral length of the support cylinder 8, a portion of the sleeve 4 in quadrants three and four of the cylinder 8 may not be close to a peripheral surface 11 of the magnetic support cylinder 8 but may project away from cylinder peripheral surface 11 at a distance "a".

A sleeve tensioning assembly is placed in an interspace area 10 that is formed between the periphery 11 of the magnetic support cylinder 8 and that portion of the endless sleeve 4 which projects in a position at a distance "a" from the periphery 11 of the cylinder 8. In a first embodiment, the sleeve tensioning assembly can be a sleeve tightening device 12 which is securely adjustably attachable to a frame portion of the unit 1 and is displaceable toward and away from the support cylinder 8. This tightening device or sleeve tightener 12 serves to support the sleeve 4 as it is peeled off the periphery 11 of the magnetic support cylinder 8 after the sleeve has passed through the engraving gap between the work head 5 and the magnetic support cylinder 8. The work head 5 can support an engraving needle, or a laser beam or electron beam device that is suitable for engraving. Such devices are commercially available from, for example, the firm Hell.

In accordance with the present invention, it is possible to provide the sleeve tensioning assembly in either a sleeve contacting or non-contacting configuration. Thus the sleeve tensioning assembly can either contact or not contact an inner side or inner peripheral surface 14 of the endless printing sleeve 4. As may be seen in FIGS. 1 and 3, the sleeve tightening assembly 12 can be in the form of a tightening device having a circular segment shaped cross-section which will engage the inner peripheral surface 14 of the sleeve 4. If the tightening device 12 contacts the inner surface 14 of the sleeve 4, it may have a smooth, low friction curved outer surface, as seen in FIG. 1, or may have a plurality of rollers 16 on the circular segment shaped outer surface 17, as may be seen most clearly in FIG. 3. These rollers 16 may be supported for easy rotation and may be distributed over the entire width and along the length of the circular segment shaped part 17. Alternatively, one larger single roller could be utilized. Alternatively, there could be provided a sleeve tensioning assembly utilizing compressed air jets that are positioned so as to blow compressed air between the free part of the printing sleeve 4 and the peripheral surface 11 of the magnetic cylinder 8.

Figure 5:
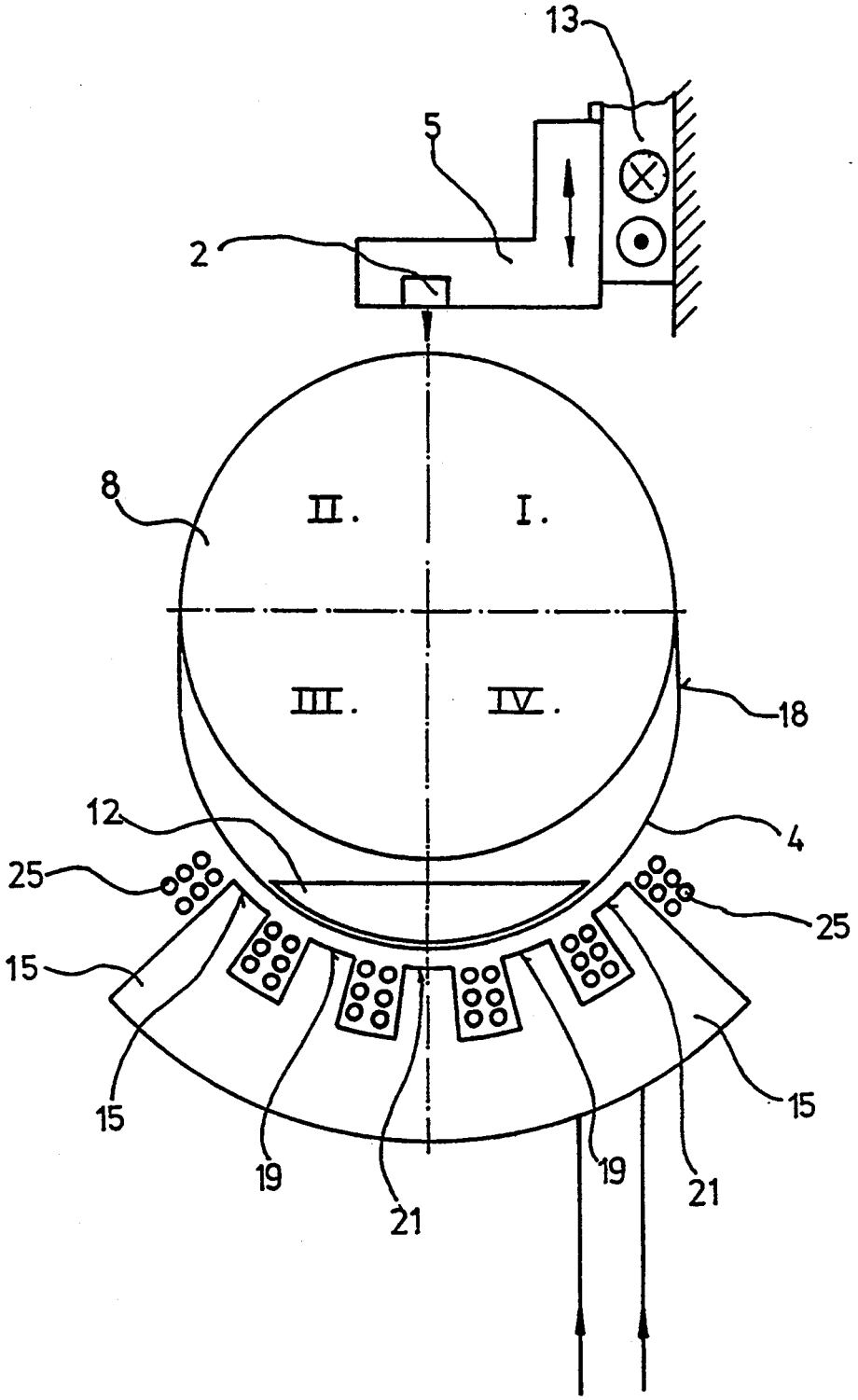
FIG. 5 is a view similar to FIG. 4 and showing a third sleeve tensioning assembly.
Figure 6:
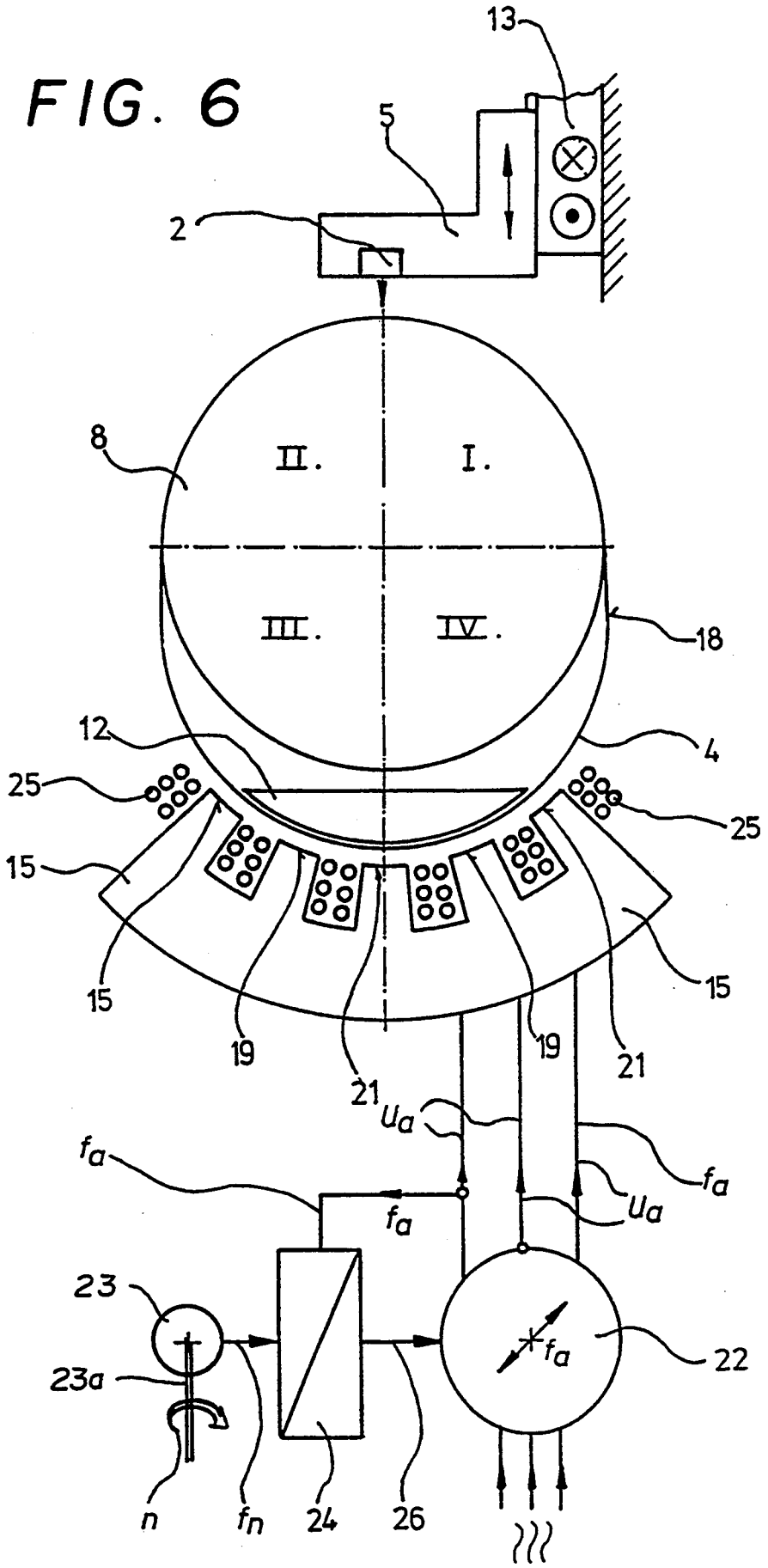
FIG. 6 is a view similar to FIG. 4 and showing a fourth sleeve tensioning assembly in accordance with the present invention.

Turning now primarily to FIGS. 4–6, there may be seen several alternative versions of a sleeve tensioning assembly in accordance with the present invention. These are magnetic sleeve tensioning assemblies which utilize magnetism and the magnetic inner ply 6 of the sleeve 4 to impart a tension to that portion of sleeve 4 which is not in physical contact with the magnetic cylinder 8. As is seen in FIGS. 4–6, there can be provided magnetic tightening assemblies 15 which are secured to the printing press frame exteriorly of the endless sleeve 4 and which attract the sleeve 4 by magnetic force. This tightening assembly 15 is preferably located outside of the interspace 10, in contrast to the contact type of tensioning or tightening assembly shown at 12 in FIGS. 1 and 3. This magnetic tightening assembly 15 effects the sleeve 4 over an outer side 18 of sleeve 4. The magnetic tightening assembly 15 has a concave magnetic area 19 taken in the direction of the endless sleeve 4 with this concave area 19 being shaped to be adapted to a maximum admissible curvature of the free or unsupported portion of the printing sleeve 4. Each such magnetic sleeve tensioning assembly 15 operates in combination with the sleeve tightening device 12.

In this configuration shown in FIG. 4, the concave magnetic area 19 can have a number of strong permanent bar magnets which are arranged so that their poles end in the concave surface 19 of the non-contact tensioning or tightening assembly 15. In this connection, the magnetic north and south poles are, looked at over the width of the magnetic area 19, arranged at a distance adjacent each other.

Instead of the permanent bar magnets discussed above, the magnetic area 19 can be provided as electromagnets with limbs and cross arms or bars and yokes, as shown in FIG. 5 that are surrounded by a current coil 25. In this instance, the ferro-magnetic part of the printing sleeve 4 forms the armature for the magnets and is arranged at a small distance from the limbs of the electromagnets. In the sleeve tensioning assembly 15 using either permanent magnets or electromagnets in the magnetic area 19 the free or unsupported portion of the endless sleeve 4 is drawn toward the sleeve tensioning assembly 15 without actually being in contact with it.

A third magnetic sleeve tensioning assembly 15 is shown in FIG. 6. In this third magnetic sleeve tensioning assembly 15 there is utilized a synchronous or asynchronous travelling field motor in the form of an asynchronous sector or linear motor 21. In this non-contact sleeve tensioning assembly 15 an inner radius of curvature of the linear motor 21 is adapted or configured to the outer curvature of the endless printing sleeve 4. This radius of curvature may also be adapted to the radius of curvature of the sleeve tensioning or tightening assembly 12 that is located intermediate the magnetic support cylinder 8 and the endless printing sleeve 4.

The sector or linear motor 21 is fed by a frequency-converter device 22, such as a static or dynamic three-phase current frequency converter. The frequency-converter device 22 generates a three-phase current having a frequency fa which is proportional to the machine speed n. To achieve this, a frequency generator 23 generates an output frequency fn which is directly proportional to the rotational speed n of an input shaft 23*a* that rotates at the same speed as the magnetic cylinder 8. The output from the frequency generator 23 is fed to a regulator 24 which compares the desired frequency fn to the actual frequency fa generated by the frequency converter device 22, and supplies a corresponding electrical control output 26 to the frequency converter device 22. In this manner, the control output 26 insures that the output frequency of the frequency converter device 22 will remain proportional to the speed of the magnetic cylinder 8. The frequency converter device 22 provides a three-phase current output at frequency fa with a voltage Ua to a three-phase current coil 25 of the sector motor 21. This causes a magnetic force to be generated in the direction of rotation of the magnetic cylinder 8 according to the variable frequency fa which draws the printing sleeve 4 toward the sector motor 21. As a result, the printing sleeve 4 is tensioned thereby and neither touches the surface of the segment-tightener 12 nor the stator poles of the sector motor 21.

Turning now to FIG. 2, it will be seen that the magnetic support cylinder 8 of the present invention utilizes a large number of permanent magnet pole devices 27 in a generally known manner, as disclosed in German document No. DE 22 31 452 A1 to form the magnetic device. These magnetic pole devices 27 generate a strong magnetic field over the entire outer peripheral surface 11 of the circumference of the magnetic support cylinder 8. These magnetic pole devices 27 each consist of a permanent magnetic part 28 and of magnetic pole pieces 29. These permanent magnet parts 28 and magnetic pole pieces 29 are alternatingly arranged adjacent each other on the surface of the cylinder circumference or periphery 11.

While the magnetic support cylinder 8 and endless sleeve 4 in accordance with the present invention has been discussed hereinabove for use in gravure printing, it will be understood that its use is not limited only to this type of printing. The outer layer of the ferro-magnetic endless printing sleeve 4 could, for example, consist of aluminum which could be capable of being used in offset printing. This aluminum layer could carry a light-sensitive coating and could thus be used as an offset printing plate.

As may be seen most clearly in FIGS. 1 and 4–6, the work head 5, which is supported by the slidable carriage 13 in the frame and thus also the engraving or other pattern forming mechanism 2 which is carried by the work head 5 can be displaced vertically and horizontally on the carriage 13. The work head 5 and its associated mechanism 2 for forming the shallow indentations on the outer jacket or sleeve surface 7 of the endless sleeve 4 can be brought into operative position with respect to surface 7. This means that if an engraving tool is used as the pattern forming mechanism 2 that the engraving tool will contact the jacket surface 7. If a contactless device 2 is used for generating the shallow impressions in the jacket 7 or if there is accomplished a digital exposure of a light sensitive or offset layer on the endless sleeve 4, the work head 5 will be positioned at a preset distance from the jacket surface 7. During engraving or digital exposure of the endless sleeve 4, the magnetic support cylinder 8 rotates and in this way, an engraving or exposure track or path is generated on the jacket surface 7, with this track extending in the direction of the circumferential length of the endless printing sleeve 4. Once this track is finished, the work head 5 and its associated engraving or other pattern forming device 2 is displaced by one step of predetermined length in the horizontal or axial direction of the magnetic support cylinder and the engraving or exposure operation is again started. This procedure is continued until the complete pattern is engraved or otherwise formed on the outer jacket surface 7 of the endless forme or printing sleeve 4.

The magnetic support cylinder 8 has been discussed hereinabove as being rotatably supported. It is also possible to utilize a non-rotating cylinder 8. In this configuration, the endless sleeve 4 is still supported on the support cylinder 8 and is driven by the sector or linear motor 21, as described above because of the use of the ferromagnetic inner ply or layer 6 of the endless sleeve 4.

While a preferred embodiment of a device for creating a printing pattern on a forme sleeve in accordance with the present invention has been set forth fully and completely hereinabove, it will be apparent to one of skill in the art that various changes in, for example the overall size of the support cylinder, the width of the endless sleeve, the number of magnets used and the like can be made without departing from the true spirit and scope of the present invention which is accordingly to be limited only by the following claims.

What is claimed is:

1. A device for supporting an endless flexible forme sleeve and for forming a printing pattern on an outer jacket surface of said forme sleeve, said device comprising:

a support cylinder having a peripheral support surface with an outer circumferential length;

an endless forme sleeve having an outer jacket surface and an inner circumferential length, a portion of said forme sleeve being supported on said support cylinder only during formation of a printing pattern on said outer jacket surface, said inner circumferential length of said endless forme sleeve being greater than said outer circumferential length of said support cylinder;

means for generating said printing pattern on said portion of said outer jacket of said endless forme sleeve while said portion of said endless forme sleeve is supported by said support cylinder; and means for moving said endless forme sleeve with respect to said printing pattern generating means.

2. The device in accordance with claim 1 wherein said support cylinder is supported for rotation.

3. The device of claim 1 wherein said support cylinder has a magnetic outer surface.

4. The device of claim 3 wherein said endless printing sleeve has an inner ply which consists of a ferromagnetic material.

5. The device of claim 4 wherein an outer layer of said sleeve is a non-ferromagnetic material.

6. The device of claim 5 wherein said outer layer of said sleeve consists of an aluminum layer with a light-sensitive layer.

7. The device of claim 1 further including a sleeve tensioning assembly which is usable to impart a tensioning force to said endless sleeve.

8. The device of claim 7 wherein said sleeve tensioning assembly is a circular segment shaped member positioned intermediate said cylinder and said sleeve and displaceable toward and away from said cylinder.

9. The device of claim 8 wherein said circular segment shaped member has a face in engagement with said inner peripheral surface of said sleeve, said face carrying rotatable roller bodies.

10. A device for supporting an endless flexible forme sleeve and for forming a printing pattern on an outer jacket of said endless flexible forme sleeve, said device comprising:

a support cylinder having a peripheral magnetic support surface with an outer circumferential length;

an endless flexible forme sleeve having an outer jacket surface and an inner ferromagnetic layer having an inner circumferential length, a first portion of said endless flexible forme sleeve being supported by said support cylinder during formation of a printing pattern on said outer jacket surface, said inner circumferential length of said endless forme sleeve being greater than said outer circumferential length of said support cylinder;

means for generating said printing pattern on said first portion of said outer jacket of said endless flexible forme sleeve while said first portion of said endless flexible forme sleeve is supported on said support cylinder;

means for moving said endless forme sleeve with respect to said printing pattern generating means; and a sleeve tensioning assembly usable to impart a tensioning force to a second portion of said endless flexible forme sleeve which is not supported by said support cylinder.

* * * * *